United States Patent [19]

Bubley

[11] Patent Number: 4,909,142

[45] Date of Patent: Mar. 20, 1990

[54] TURNTABLE MOUNTING FOR AUTOMATIC MULTI-COLOR PRINTING APPARATUS

[75] Inventor: Henry J. Bubley, Deerfield, Ill.

[73] Assignee: American Screen Printing Equipment Corporation, Chicago, Ill.

[21] Appl. No.: 197,862

[22] Filed: May 24, 1988

Related U.S. Application Data

[63] Continuation-in-part of Ser. No. 932,779, Nov. 19, 1986, abandoned.

[51] Int. Cl.[4] ..... B41F 15/10

[52] U.S. Cl. ..... 101/115; 384/452; 384/609

[58] Field of Search ..... 101/115, 126; 384/226, 384/242, 243, 452, 453, 454, 455, 603, 604, 608, 609, 613, 616, 590; 74/823

[56] References Cited

U.S. PATENT DOCUMENTS

| | | | |
|---|---|---|---|
| 1,145,621 | 7/1915 | Shafer | 384/243 |
| 2,485,289 | 10/1949 | Jáne | 101/115 |
| 2,613,595 | 10/1952 | Weldon | 101/115 |
| 3,427,964 | 2/1969 | Vasilantone | 101/115 |
| 4,099,460 | 7/1978 | Bubley et al. | 101/115 X |
| 4,583,458 | 4/1986 | Beachum | 101/126 |
| 4,669,378 | 6/1987 | Lee | 101/126 X |
| 4,753,162 | 6/1988 | Bubley | 101/115 |

FOREIGN PATENT DOCUMENTS

| | | | |
|---|---|---|---|
| 217796 | 1/1910 | Fed. Rep. of Germany | 74/823 |

*Primary Examiner*—Clifford D. Crowder
*Attorney, Agent, or Firm*—Fitch, Even, Tabin & Flannery

[57] ABSTRACT

A multi-color printing apparatus for screen printing workpieces in diverse colors. The apparatus has a plurality of printing units, each located at a work station, and spaced about a central support. A number of radially extending support arms cantilevered from a rotatable central support carry the workpieces between printing stations. After being indexed to its approximate final position at a particular work station, the support arms engage a brake pad to absorb rotational energy and to control motion of the support arm during a final, precise alignment step wherein a fork member is advanced toward a roller mounted on the support arm to precisely align and lock the support arm during the screen printing operation. Also disclosed is a collar for rotatably mounting the central support at its bottom end. The collar has two portions, one mounted to the central support and the other mounted to a desired location in the printing apparatus. Ball bearings are received in opposed grooves in the two collar portions to provide a precise alignment and thrust bearing support for the central support. Also disclosed is a guide plate mounted adjacent the central support. Rollers mounted on arms attached to the central support contact the edge of the plate and are adjustable to locate the upper end of the column about a true vertical axis of rotation and to prevent inclination of the central support about this vertical axis of rotation.

14 Claims, 6 Drawing Sheets

TURNTABLE MOUNTING FOR AUTOMATIC MULTI-COLOR PRINTING APPARATUS

This application is a continuation-in-part application of patent application Serial No. 932,779, now abandoned filed Nov. 19, 1986 entitled "Automatic Multi-Color Printing Apparatus", the disclosure of which is herein incorporated by reference.

BACKGROUND OF THE INVENTION

1. Field of the Invention

This invention relates to multi-color screen printing apparatus and more particularly to mechanizing manual screen printing apparatus heretofore used to print multi-color on workpieces, typically textile goods mounted on pallets carried on a rotatable indexer with each pallet being indexed to each of several printing stations at which a printing screen was swung downwardly by the operator who also manually moved the squeegee back and forth across the screen in print and flood strokes.

2. Description of the Prior Art

In addition to the manual apparatus disclosed in the aforesaid patent application Ser. No. 932,779, larger and more expensive screen printing apparatus is available for multi-color printing as disclosed in U.S. Pat. No. 4,099,460 and U.S. Pat. No. 4,724,760. In this latter kind of apparatus, a central turntable or in indexer has a plurality of arms each carrying a workpiece into each of a plurality of print units which are located peripherally about the indexer and which are free-standing screen printers. That is, the screen printers are standing alone and are mounted on the floor at locations radially outward of the indexer which carries a series of circumferentially spaced workpieces and intermittently shifts each workpiece into a registration position beneath the printing screen and the squeegee and flood bar of a printer unit. A motor drive lowers the print head and screen and a motor drive reciprocates the squeegee across the screen to print on the workpiece therebelow. The timing and registration of the indexer movement to the actuation of the printing units is achieved by a Geneva drive and a locking registration bar and pin arrangement which interlocks the large mass of the indexer to each print head, such indexer movement and registration is disclosed in U.S. Pat. No. 4,724,760. The printing units are very heavy and large machines having their separate motors, printing head lift mechanisms, and squeegee and flood bar actuating mechanisms. This is in contrast to the manual machine which has no printing head motor lifts and no motorized actuation of the squeegee through print and flood strokes.

The present invention is directed to mechanization of machines which were previously manually operated, but without having the stand-alone separate printing units located radially outwardly of the indexer. Because these manual machines are substantially less expensive than the stationary large stand-alone printers with their common workpiece indexer, it is desired to build a machine which costs substantially less than the machine having the larger stand-alone multi-printers and a machine which will be attractive in price to users of the manual multi-printers because of savings in labor costs due to faster printing with less manual labor. A number of problems arise in mechanization of such equipment and among these are the supporting of multiple printing heads on the indexer without making the indexer too massive or expensive and achieving an economical and simple way of supporting the heavy vertical load, balancing the units for rotation, and registering for printing at each of the print stations.

SUMMARY OF THE INVENTION

The aforesaid abandoned patent application Ser. No. 932,779 provided a screen printing press having a central stationary shaft for supporting a plurality of printing units spaced about an upper circular path. An outer shaft, mounted for rotation carried a plurality of pallets for transporting printing stock between the various printing heads. In the course of constructing commercial embodiments of the printing press, the need arose for a simple and inexpensive supporting of a heavy load and balancing and registering each printing station both radially and circumferentially about a central axis.

It is therefore an object of the present invention to provide a new and improved multi-color screen printer which will allow the quick and accurate successive printing of a plurality of differently colored registered patterns on a single workpiece.

It is another object of this invention to provide a new and improved multi-color printer of simplified design which is adaptable to a wide variety of uses.

Yet another object of the present invention is to provide a multi-color printer having a turntable and motorized printing heads mounted from concentric vertical shafts.

A further object of the present invention is to provide an improved mounting for the rotatable shaft of the above-described printing press.

These and other objects of the present invention which will become apparent from studying the appended description and drawings, are provided in a mechanized screen printing apparatus which includes a rotatable column having a vertical axis and a plurality of printing units circumferentially spaced about the vertical axis so as to define a plurality of printing stations. Work supports carried on the rotatable column transport a workpiece toward and away from a printing station. The rotatable column is mounted for rotation about the vertical axis. The mounting means include a collar secured about the rotatable column at a lower end thereof with a bottom surface defining an upwardly-facing continuous groove. A base located beneath the lower end of the rotatable column provides load-bearing support thereto. An upper surface of the base defines a downwardly-extending continuous groove, the base being mounted so that the groove thereof directly opposes the groove of the collar. Rolling bearing means, positioned between the collar and the base, are disposed in the grooves thereof so as to support the rotatable column for rotation about the vertical axis. Guide means, in contact with the rotatable column and above the collar, restrict inclination of the rotatable column away from the vertical axis.

Other objects of the present invention are provided in a central stationary post co-axially arranged within the rotatable column and carrying a plurality of printing units. A guide plate, outwardly extending from the central post, has an outer circular guide surface concentrically arranged with the vertical axis of the rotatable column. A plurality of outwardly extending arms are mounted to the rotatable column for rotation therewith, each arm having a guide roller mounted thereto for contacting the outer surface of the guide plate, thereby bringing the rotatable column into alignment with the central column.

Other objects of the present invention are provided in a friction pad mounted underneath the work supports and having an upper surface precisely positioned at a desired vertical height. As the work supports are slowed to approach a desired angular position in alignment with the printing units, the work supports engage the pad to provide a final braking thereof. The pad includes an inclined leading edge which is continuously blended into an upper surface of the pad so that a work support during the final braking is elevated to a precise, desired position. The work support maintains contact with the pad, so as to receive support therefrom during a printing operation.

Other objects of the present invention are provided in locking and positioning means which include a mounting means vertically movable toward and away from an overlying support, and interengageable roller and fork means mounted on the work support and the mounting means. The fork means is preferably carried on the mounting means and includes roller-engaging tapered walls defining a tapered recess for receiving the roller means which is mounted on the work support. When the fork means is advanced toward the roller means, the roller means and hence the work support, is brought into a precise alignment and is locked against angular displacement during a printing operation.

BRIEF DESCRIPTION OF THE DRAWINGS

In the drawings, wherein like elements are referenced alike.

DETAILED DESCRIPTION OF THE PREFERRED EMBODIMENT

Figure 1:
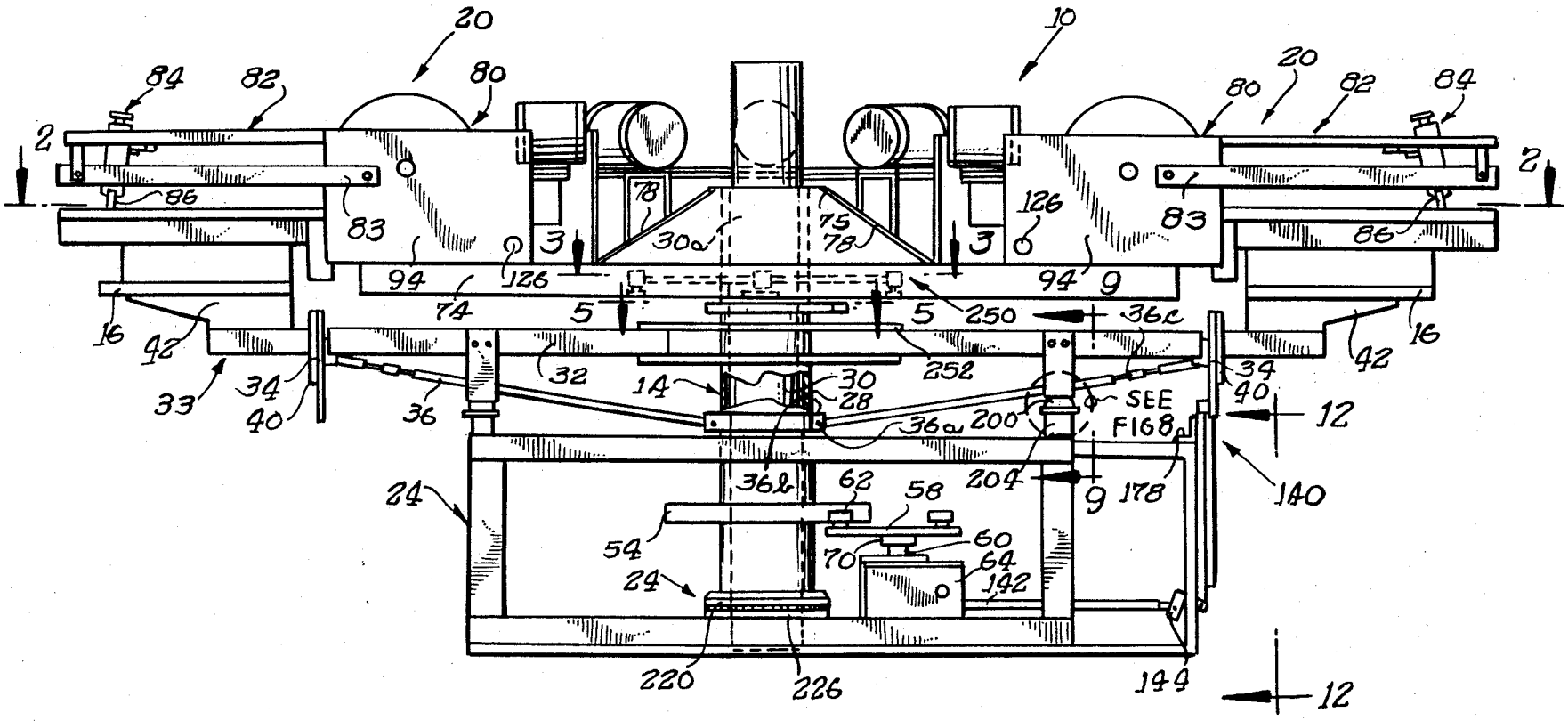
FIG. 1 is an elevational view of a printing press arrangement with eight printing stations, embodying the present invention.
Figure 2:
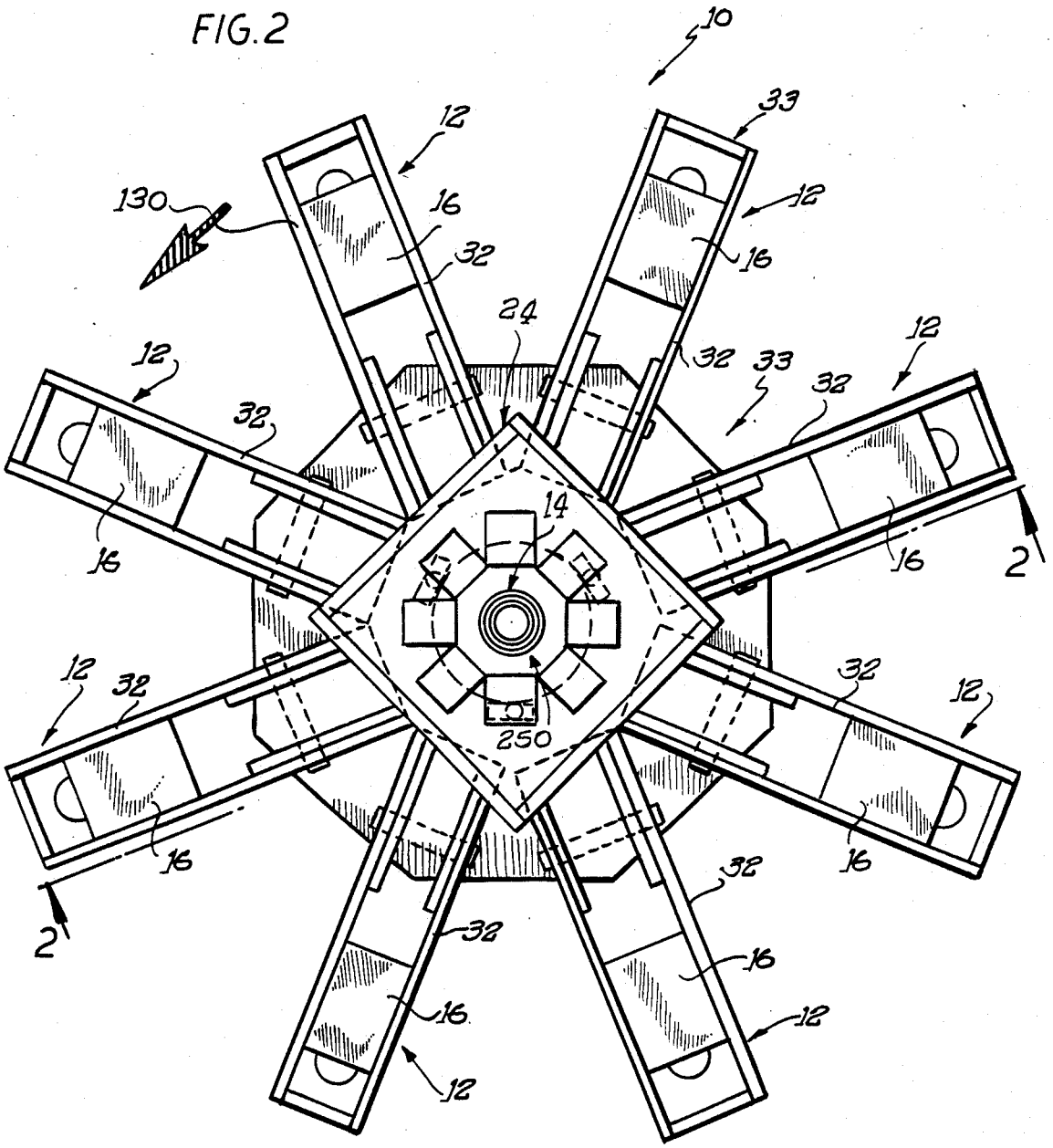
FIG. 2 is a partial, cross-sectional plan view taken substantially along the line 2—2 of FIG. 1.

Referring now to the drawings, FIGS. 1 and 2 illustrate a multi-color printing apparatus of the type described in abandoned patent application Ser. No. 932,779 which is herein incorporated by reference. The printing apparatus indicated generally at 10, is illustrated to show eight printing stations, indicated generally at 12 (see FIG. 2), disposed about a central support 14. Apparatus 10 is mechanized and is fully automatic, including work supports or pallets 16 for transporting a plurality of pallets 16 between printing stations 12. Pallets 16 carry workpieces such as textile goods, finished garments or the like printing stock, to be printed upon by a sequence of printing units 20 (see FIG. 2), each printing head applying a different colored pattern to the workpiece. Apparatus 10, as illustrated in the figures, is capable of printing a multi-color image containing up to eight different colors. The images printed at the several printing stations, when superimposed one over the other on a workpiece, produce the desired composite multi-colored work. It is therefore important in multi-color apparatus of this type to provide accurate and consistent registration between the workpieces and the printing units at each printing station. Not only must the workpiece be registered with respect to the pallet, the pallet must thereafter be registered with respect to the printing heads under which it is positioned. Pallets 16, as will be seen, are carried on a turret or turntable which is supported from below by a rotating column or shaft. Accurate and consistent registration of the workpiece depends upon the accurate vertical alignment of the rotating shaft axis, as well as the proper location of that shaft axis relative to remaining portions of the printing apparatus, especially the printing heads.

Referring now to FIGS. 1-2, printing apparatus 10, the upper portion of the apparatus is stationary, and includes the printing units 20 carried by a central support 14 mounted in a base 24. This is an important feature of the invention in that a very heavy load of up to eight printing heads are supported from a single central column with the workpieces being carried by pallets about and beneath the printing units.

Figure 6:
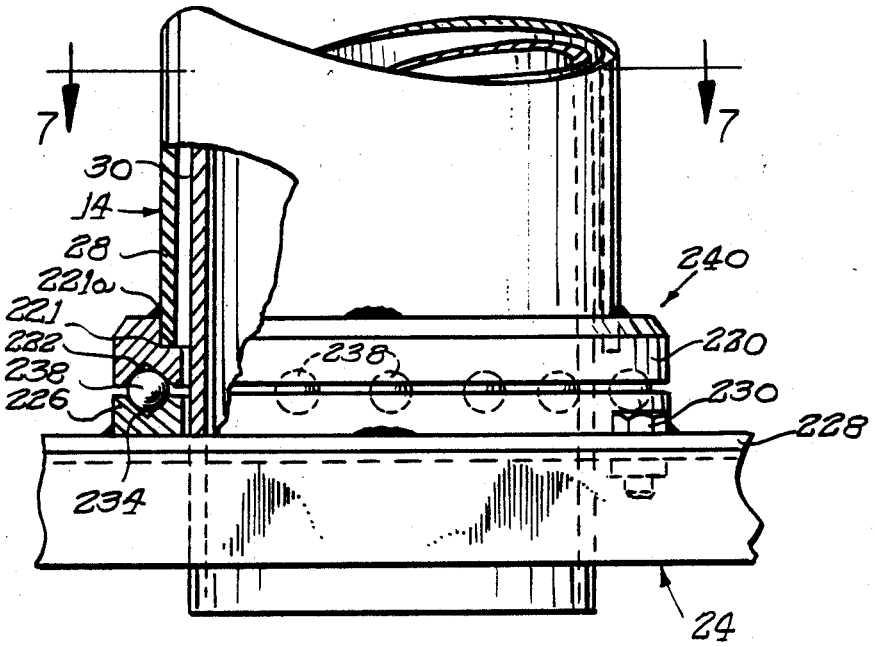
FIG. 6 is an enlarged fragmentary view of FIG. 1, shown partly in cross-section.
Figure 7:
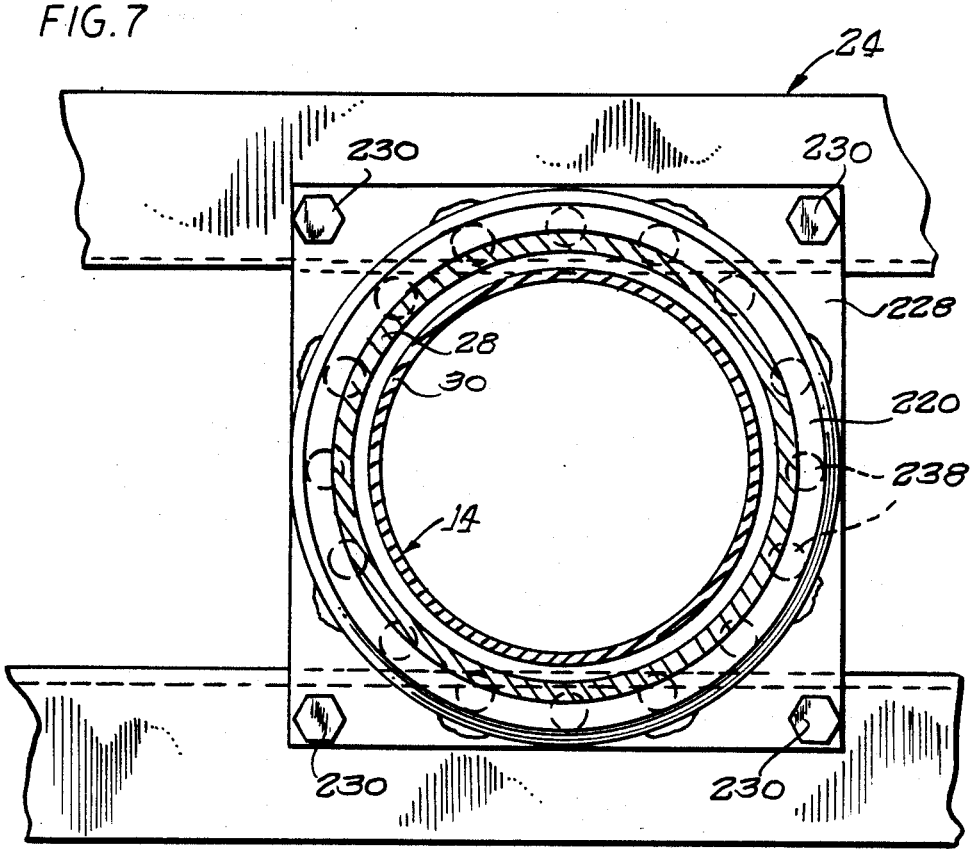
FIG. 7 is a fragmentary plan view taken substantially along the line 7—7 of FIG. 6, looking in the direction of the arrows.

As can be seen most clearly in FIGS. 6 and 7, central support 14 includes an outer rotatable column support 28 and an inner fixed column support 30. Eight support arms 32 are cantilevered from outer column support 28, being affixed thereto for rotation therewith at their inner end by a welded joinder. Support arms 32 carry pallets 16 at their outer, free ends. An upstanding plate 34 is welded to the free end of support arm 32, and an adjustable strut 36 is pinned to the lower end of plate 34 to assist in supporting the weight of that arm and is pinned at its inner end by a pin **36*a* to a circular plate 36*b* fixed to the column support 28. A threaded turnbuckle 36*c* is provided in each link and is threaded to turn to extend or contract the length of the link. The arm 32, link 36 and the portion of the column 28 between the plate 36 and the arm 32 constitute a triangular support. By lengthening or contracting the link, the pallet 16 may be positioned in a horizontal plane. This strut and column support allows as many as eight movable pallets and workpieces to extend underneath the stationary printing units without bouncing or otherwise vibrating or moving during the printing operation. This construction of the central column, platforms and struts provides an inexpensive and simple construction that allows the apparatus to be competitively priced. A mounting plate 40 joined to plate 34 by welding or the like provides bolted mounting for a riser member 42 which directly supports pallet 16. As indicated above, arms 32 are secured to outer column support 28 for rotation therewith, and form a turntable generally indicated at 33. Referring to the bottom of FIG. 1, outer column 28 has a drive wheel 54 secured thereto at its lower portion. Drive wheel 54 contains downwardly-opening curved slots (not shown) beginning at a point adjacent column 28 and extending to the periphery of drive wheel 54. The slots are closed on three sides and open on the bottom. A drive arm 58 is mounted for rotational movement about a drive or output shaft 60 on a plane parallel to that of drive wheel 54. On opposing ends of the drive arm 58 are attached rollers 62 which extend upwardly from the drive arm 58** fitting within a curved slot of the drive wheel to form a curved Geneva drive mechanism.

The drive arm 58 rotates under the driving force of a motor located within drive housing 64. Output shaft 60 has a collar 70 with a peripheral switch-camming surface which engages limit switches (not shown) for controlling energization of the drive motor. The control switches, in combination with the gear mechanism, drive arm and drive wheel, produce a continuous succession of stepped rotational movements to the support arms 32 and the workpieces 16 carried thereon. The stepped motion provides an indexing of pallets between printing stations and provides a fairly accurate registration of each pallet at its printing station, so as to be aligned for a registration operation with the printing head overlying the pallet. The Geneva drive mechanism and a brake will stop the indexer and pallets at the desired index positions but the finer registering operation is then needed to assure registration of each print from each printing head. Further details concerning the drive and indexing of support arms 32 including the curved Geneva mechanism is given in U.S. Pat. No. 4,724,760, the disclosure of which is herein incorporated by reference.

Inner column 30, concentric with rotating column 28, is fixedly supported by base 24. As shown most clearly in FIG. 1, inner column 30 includes an upper portion **30*a* which extends above a table structure 74 which is welded at its inner end to the outer surface of column 30, which is exposed by reason of its projecting beyond the end of the outer rotating column 28. As shown, column 28 is terminated at its joinder with support arms 32. Table 74 is supported by tensioned struts 78 which are secured between medial portions of table 74 and a collar-like bracket 75 at the upper end of inner column 30**.

Printing units 20 are constructed in accordance with teachings of commonly-assigned U.S. Pat. No. 4,524,687 issued to Henry J. Bubley on June 25, 1985, the disclosure of which is herein incorporated by reference. Printing units 20 generally include an actuating mechanism 80 and a pivotally mounted printing head 82 which has pivotally mounted support arms 83 in which reciprocates a squeegee and flood bar carriage 84 carrying a flood bar (not shown) and a squeegee 86 to perform printing and flooding strokes. Actuating mechanism 80 for each printing station includes a drive motor, gear train and an operating mechanism contained between vertical mounting walls 94, preferably formed of relatively heavy-gauge metal plate. The gear train provides synchronized movement of squeegee 86 back and forth along the print head.

Print head 82 is pivotally mounted to table 74 by pivotal mounting shaft 126 and is upwardly movable away from the position indicated in FIG. 1, that is, away from pallet 16, to allow indexing rotation of the pallets between printing stations, and is lowered toward pallet 16 to prepare for a printing operation performed on a workpiece carried by the pallet, wherein squeegee 86 is moved in a back and forth motion to carry out printing and flooding strokes, as is known in the art.

According to one aspect of the present invention, accurate registration is provided between pallets 16 and printing stations 12, each of which includes its own printing unit 20. Each printing unit 20 prints a different colored design on the workpiece, differently colored designs applied by each printing unit forming a composite which comprises the desired multi-colored artwork. In order to successfully provide the desired composite artwork, it is essential that the workpiece be correctly registered on a pallet 16 and that, with each step rotation of turntable 33, the pallet 16 is brought into correct registration with a printing unit 20. Each printing operation follows a well-defined pattern, and takes place during a 180° rotation of the motor driven output shaft 60, illustrated in FIG. 1. The motor within drive housing 64 is energized, causing the output shaft 60 to rotate until a limit switch contacts a cam surface on collar 70 to de-energize the drive motor, stopping rotation of the output shaft 60. At this point, the turntable 33 is indexed to bring the pallets into registration with adjacent, downstream printing units, the turntable 33 being locked in the registered position until the printing operation is completed. At the end of the printing operation, after the printing heads 20 are raised, the output shaft 60 begins rotation to start another printing operation, as described.

Operating in timed relationship with the output shaft 60 and turntable 12, is a locking means generally indicated at 140 (see FIGS. 11 and 12), which registers and locks the turntable 33 in the correct position upon indexing of the pallets to succeeding stations. Actuation of the locking means is initiated by a timing wheel in drive housing 64, coupled to output shaft 60 for timed movement therewith. A link arm 142 is connected between the timing wheel and a bell crank 144. Bell crank 144 is rotatably mounted by pin 146 and has a first arm pinned at 148 to one end of link arm 142. Actuation of the locking means 140 is initiated by the timing wheel which drives link arm 142 in timed relationship to the rotation of output shaft 60. As the timing wheel is rotated, link arm 142 is reciprocated back and forth, causing bell crank 144 to pivot about its mounting 146.

Figure 11:
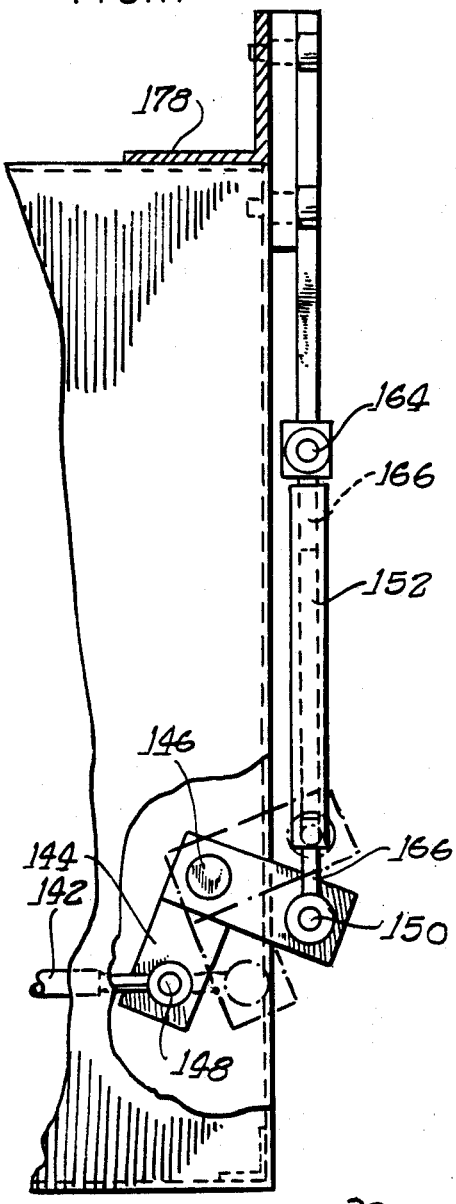
FIG. 11 is an enlarged fragmentary view of FIG. 1, showing the turntable locking portion thereof.

A second arm of bell crank 144 is pinned at 150 to a generally vertically extending link rod 152. A locking plate 154 is disposed above the link rod, being held captive in a mounting 156, which allows vertical reciprocation of the locking plate. A guide pin 158 is received in slot 160 of the locking plate to aid in maintaining the generally vertical alignment of the locking plate about its range of movement. Optionally, slot 160 can be sized so that guide pin 158 contacts end portions of the slot to limit upward and downward displacement of the locking plate 154. However, it is generally preferred that the displacement of locking plate 154 be controlled by the displacement of link rod 152, which is pinned at the lower end of locking plate 154 by a pin connection 164. As indicated in FIG. 11, it is preferred that the pin connections 150, 164 at either end of link arm 152 are threadedly adjustable. Preferably, pin connections 150, 164 include threaded shaft portions 166 receivable in a threaded bore of link rod 152.

The upper end of locking plate 154 has a fork or upwardly opening V-shaped portion 170, and includes a pair of generally converging camming surfaces 172. The portion of the locking mechanism 140 thus far described is mounted on a frame member 176, rigidly attached to base 24 by a L-shaped mounting bracket 178 (see FIG. 1). Thus, the fork portion 170 of locking plate 154 travels a well-defined vertical path, the axis 180 of which is preferably aligned with a printing unit 20 in precise relationship therewith.

Figure 12:
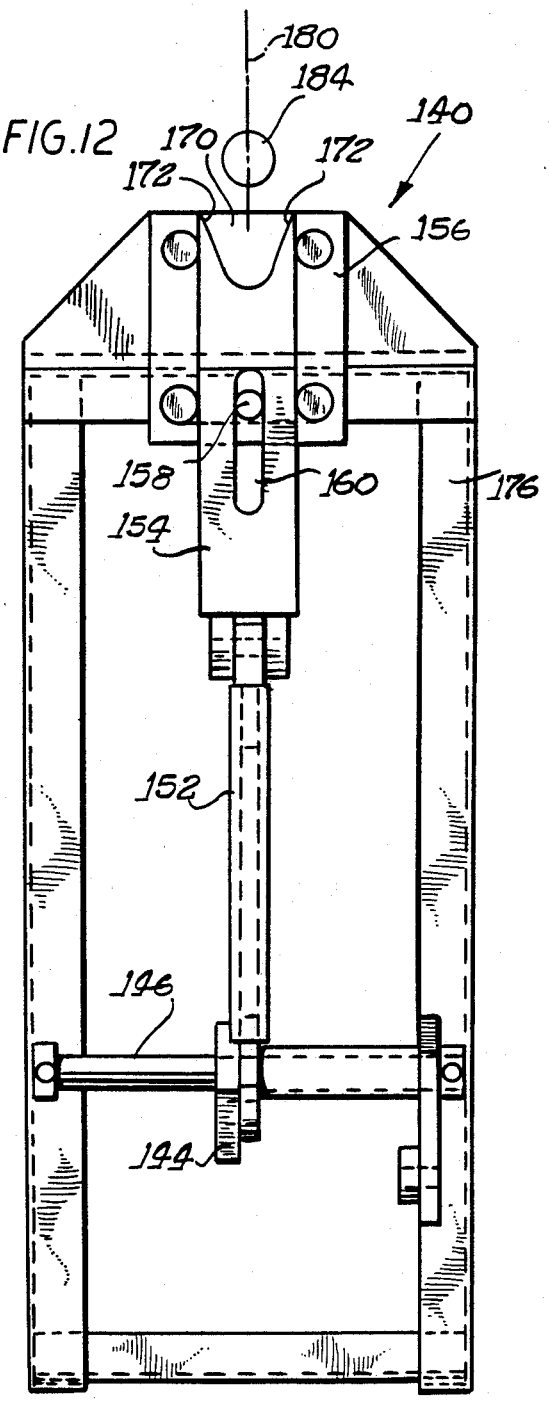
FIG. 12 is a fragmentary elevational view of FIG. 1 looking in the direction of the arrows, taken along the line 12—12 thereof.
Figure 13:
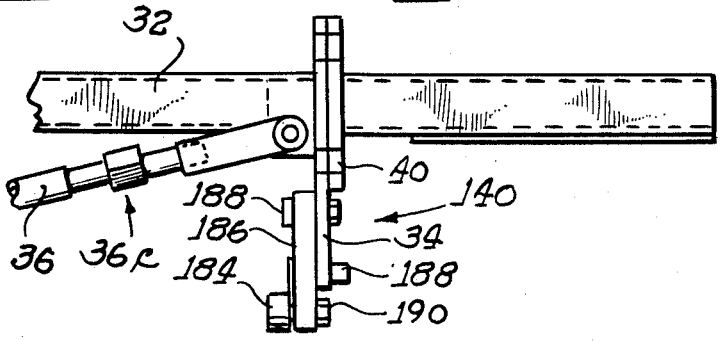
FIG. 13 is a fragmentary elevational view showing the locking and registering means for the turntable.

Referring especially to FIGS. 11 and 12, the balance of locking mechanism 140 includes a roller 184 attached to plate 34 by an adjustable mounting plate 186. By loosening bolts 188, the adjustable mounting plate 186 can be adjustably positioned, and subsequently locked in place, securely bolted to plate 34. Roller 184 is preferably mounted to adjustable plate 186 by a bolt 190 threadingly received in a horizontal shaft of the roller. Roller 184 is consequently mounted for rotation in a vertical plane.

The forked tip 170 of locking plate 154, when advanced toward roller 184, precisely positions the roller as the roller is seated in the crotch or tip of the V-shaped recess of portion 170. As link arm 142 is outwardly extended, bell crank 144, as seen in FIG. 11, is rotated in a counterclockwise direction, thereby elevating link rod 152 and, in turn, locking plate 154. As will be appreciated by those skilled in the art, precision seating of roller 184 in the crotch of forked portion 170 is improved as friction between the cam surfaces 172 of the forked portion and the outer camming surfaces of roller 184 are minimized. Although roller 184 could be replaced by a rigidly mounted cylinder or other suitably-shaped cam, but preferably is rotatably mounted, being embodied as a roller which rolls along the cam surfaces 172 of the forked portion 170.

It is generally preferred that locking plate 154 not be relied upon to absorb rotational energy of turntable 33. That is, it is preferred that turntable 33 be stationary and approximately located so that roller 184 is at least disposed above one or the other camming surface 172 of forked tip 170. Further, since the travel of locking plate 154 is limited, the vertical position of roller 184 must also be well-defined prior to actuation of locking mechanism 140. These and other features of the present invention are provided by the braking and alignment pad 200, illustrated in FIGS. 1 and 8–10. Pad 200 is preferably rigidly mounted to base 24 by a mounting plate 202 which is welded or otherwise rigidly secured to a platform 204, the lower end of which is welded to support base 24. Pad 200 preferably includes threaded studs 208 which provide removable mounting to plate 202.

A generally U-shaped bracket 212 is mounted to support arm 32 by bolt fasteners 214. Bracket 212 includes a lower, generally horizontal portion 216, the bottom surface of which contacts pad 200 as support arm 32 is rotated in the direction of arrow 130. Pad 200 is preferably tapered at its leading end **200*a* to ensure smooth engagement with the leading end 216*a* of bracket portion 216**.

Figure 10:
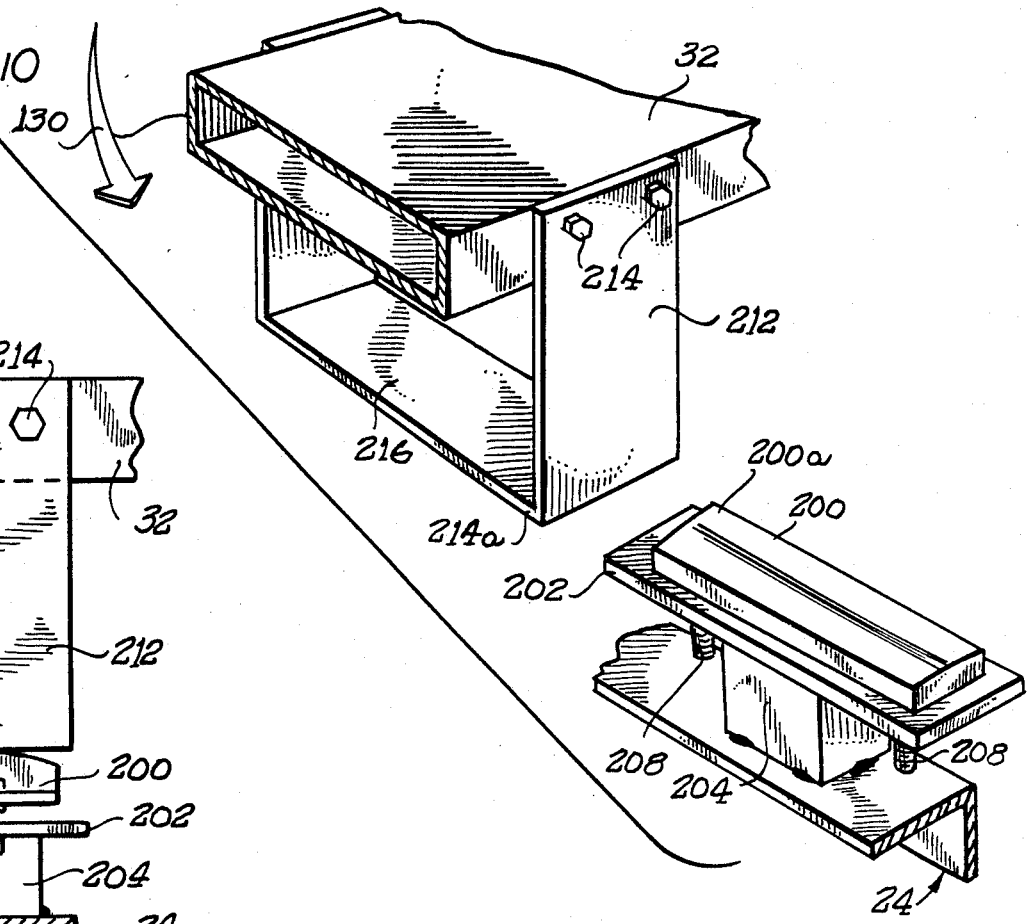
FIG. 10 is a perspective view of the rotating turret and camming alignment of FIGS. 8 and 9.
Figure 8:
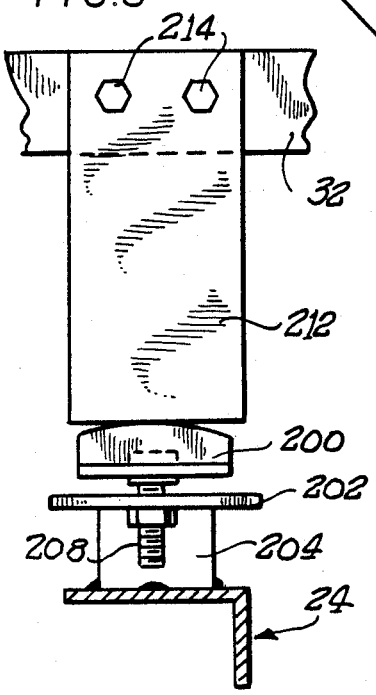
FIG. 8 is an enlarged view of a fragmentary portion of FIG. 1, showing a camming arrangement for aligning the rotatable turret portion of the printing press arrangement.
Figure 9:
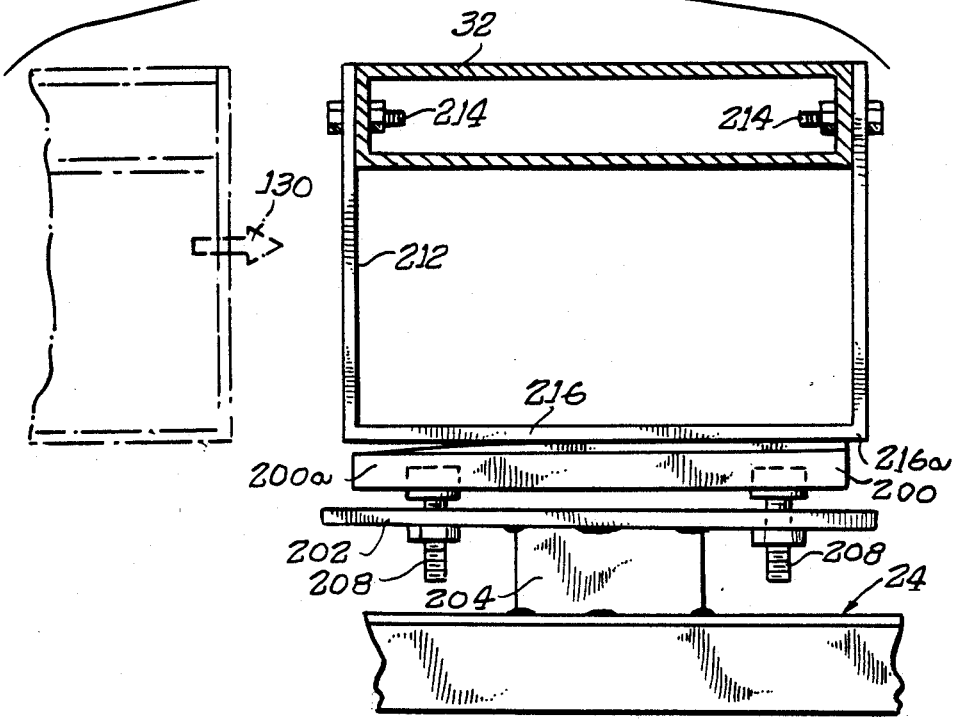
FIG. 9 is a fragmentary cross-sectional view of FIG. 1, taken substantially along the line 9—9 thereof and looking in the direction of the arrows.

As will be readily appreciated by those skilled in the art, mechanized printing apparatus of the type disclosed herein are typically quite large, having support arms as long as 10 feet or more. Although the struts 36 and the mounting of support arms 32 to the outer rotatable column 28 are quite successful in supporting the load of turntable 33, some sag or downward deflection of the support arm during operation of the machine is expected, particularly in economically constructed, commercially practical embodiments of the printing apparatus. The amount of such sag is closely limited and may be removed by adjusting the length of the link 36 by turning the turnbuckle 36C. Also, the vertical position of the roller 184 must be very precisely controlled for the reasons indicated above. Also, it is preferred that the vertical alignment of a pallet 16 at a printing station also be well-controlled during a printing operation, to ensure the intimate contact necessary between the printing screen and workpiece during a printing operation. Pad 200 reliably eliminates even the smallest amount of sag in the support arms 32, as those arms are presented to and precisely located at a printing station. As indicated in FIGS. 8 and 10, it is generally preferred that pad 200 also be tapered in directions generally normal to the path of support arm movement, to provide a well-defined line contact between pad 200 and bracket portion 214, eliminating any ambiguous, uncontrolled positioning of the support arm.

Having discussed the advantages of pad 200 as an alignment device, attention will now be turned to other important features of the pad. In operation, as turntable 33 is indexed in the direction of arrow 130, and as a pallet carried on support arm 32 approaches a printing station, limit switches de-energize the motor driving outer column 28, thus initiating the stopping of support arm rotation. As disclosed in the copending application, a brake may be used along with the curved Geneva mechanism to dissipate the inertia of the rotating turret and to stop the turret rotation without jarring as the locking plate 154 engages the roller 184 and registers and locks the turret. Herein, the pad 200 of the present invention may be used to provide the final braking of the turntable 33, aligning the support arms 32 thereof at desired angular positions such that the rollers 184 mounted to the support arms are located generally above the forked tip 170 of locking plates 154 in the manner indicated in FIGS. 11 and 12.

In addition to defining the angular position of support arms 32, pads 200, as pointed out above, advantageously provide the precise vertical positioning of the support arm, and more particularly, the rollers 184 and pallets 16 carried thereon. Further, pads 200 provide support for the support arm during a printing operation, in effect providing support for pallets 16, as a printing unit 20 is pressed thereagainst. It can thus be seen that pad 200 is important for a number of reasons in providing a successful screen printing operation, and a successful operation of locking mechanism 140. In order to provide these and other advantages, it has been found necessary to provide pad 200 with a rigid, immovable mounting and to taper the pad in the direction of pallet travel and also in directions generally normal to that direction of travel, so as to provide a line contact with a tapered lead-in where the pad engages the structure of the pallet-carrying support arm.

As will be readily appreciated by those in the screen printing art, it is essential to the accurate registration of a workpiece at multiple printing stations that the rotational axis of the pallet support structure not wobble or otherwise vary, but remain fixed in space. Heretofore, when constructing screen printing apparatus of the type described above, relatively expensive, dimensionally accurate tubing was employed to support the outer rotatable support column 28. The use of such tubing contributes significantly to the overall cost of the screen printing apparatus, but was heretofore deemed necessary to attain the rotational stability of the turntable on which the pallets are rotatably mounted. According to another feature of the present invention, more economical tubing of lesser dimensional accuracy can now be employed for the outer rotatable support column 28. It is essential, however, that the rotational accuracy of the support column be guaranteed during the construction of the screen printing apparatus, it being understood, that such axial stability of the support column 28 can usually be maintained during operation of the screen printing apparatus, if such stability is initially provided.

In general, problems associated with the use of less expensive tubing for the support columns are experienced. One problem is that the tubing, particularly that portion of tubing at the lower end of the support column may be noncircular, making an initial determination of the rotational axis of the tubing, usually based on the outer periphery of the tubing quite difficult. Also, there is a problem in mounting the outer rotating column support on bearings to take radial and thrust loads for column supports that are very large in diameter; e.g. 7 or 8 inches in diameter. The cost of large, separate roller bearings for the thrust and radial loads is too high. Sleeve bearings won't keep the tolerances of plus or minus 0.001 inch needed for print registration. In order to overcome these difficulties, the tubing comprising column 28 is preferably rotated in a centerless apparatus (not shown) to adequately determine the true axis of rotation of the tubing. Having determined the axis, a collar 220 centrally aligned with the axis and not with the tubing is attached to the lower end of the tubing, preferably by welded securement therewith. The collar 22 is carefully machined or otherwise formed apart from the tubing to have a true circular configuration, and an inner tube-receiving aperture large enough to allow telescopic insertion of the collar over the tube end prior to welding the inner ring area of the collar to the adjacent tube end.

A second problem experienced in using less costly tubing for the support column 28 is the difficulty in accurately determining a desirable loadbearing support surface therein. According to the present invention, the tubing, when rotated to determine its central axis of rotation, can be readily marked to determine a plane perpendicular to that axis of rotation. Such determination is independent of the cross-sectional shape of the lower end of the tubing. Accordingly, the tubing can be accurately cut at its lower loadbearing end for an accurately-formed butt end, using conventional tube-cutting equipment. The collar 220 when viewed in cross-section (see FIG. 6), has an inner bore with an L-shaped corner 221 formed therein. The vertical leg **221*a* of the L, as indicated above, is joined to the outer surface of the tubing forming column 228, while, as will now be appreciated, the other leg of the L is butted against the free end of that tubing. Thus, with the present invention, collar 220 can be accurately positioned about a vertical axis through the column support 28 and in a horizontal plane at the end of a dimensionally inaccurate tubing member. The race or groove 222** in the collar is cut in the collar on a lathe or other machine to be precisely located about the axis of the collar.

A third problem encountered with using less expensive tubing for the rotatable support column results indirectly from the first problems explained above. Namely, it is sometimes difficult to determine the proper position of the tube loadbearing end relative to the stationary support structure on which the printing units are mounted. According to other aspects of the present invention, the lower surface of collar 220 is preferably provided with an upwardly extending recess suitable for forming the upper half of a ball bearing raceway (see FIGS. 6 and 7). An annular support base 226 is accurately machined or otherwise formed to have a true circular configuration for the lower groove or race 234 therein with respect to the axis of the annular support base. Preferably, the annular support 226 is mounted on a generally horizontal plate 228, which can be readily bolted to support frame 24 by bolt fasteners 230, as illustrated in FIG. 7. The upper surface of annular support base 226 preferably has the downwardly extending recess 234 providing a lower half of a ball bearing raceway when aligned with the upper recess 222 of collar 220. A plurality of bearing balls 238 provide a low friction rotatable inner engagement between collar 220 and annular support base 226. Thus, a downward thrust and a radial thrust bearing support is provided for the outer rotatable column 28. An important additional advantage is that the axis of rotation of the tubing forming support column 28 is accurately located relative to support base 24 in that the recesses 222, 234 of the support collar and annular support base provide ready accurate alignment therebetween. The support collar 220, annular support base 226 and bearing balls 238, together comprise a mounting arrangement generally indicated at 240. It can now be seen that mounting arrangement 240 offers very substantial cost reductions, not only in the material costs associated with a printing apparatus, but also the labor investment in constructing and maintaining that apparatus throughout its useful life. The accuracy of registration of each printing operation depends on the precise circular movement of the printed matter from printing station to printing station and the bearings cannot be too sloppy or the registration will not be achieved.

As seen from the foregoing, the support 240, provided at the bottom end of rotatable column 228 supports the weight or thrust of the column, and also provides rotational support as well. However, practical rotational support for the outer column 28 requires a second point of support spaced from the column base and one which insures that proper registration may be assured from one printing operation to the next with an inexpensive bearing device. Referring now to FIGS. 1–5, an upper rotational support is generally indicated at 250. The upper support 250 includes a generally circular or annular guide plate 254 having an inner end 256, welded or otherwise secured to the inner, fixed column 30. The circular guide plate 254 has an outer circular edge 255. According to one aspect of the invention, the guide plate 254 is positioned so that the outer circular edge 255 thereof is concentrically located with respect to the axis of rotation of the outer column 28, and the guide plate 254 is also aligned in a plane perpendicular to the axis of rotation of the outer rotatable column 28. This perpendicular alignment of the guide plate need not be extremely precise, for reasons which will become apparent herein. The inner end 256 of guide plate 254 is preferably welded at **258*a* to the outer surface of the inner column 30**.

Figure 4:
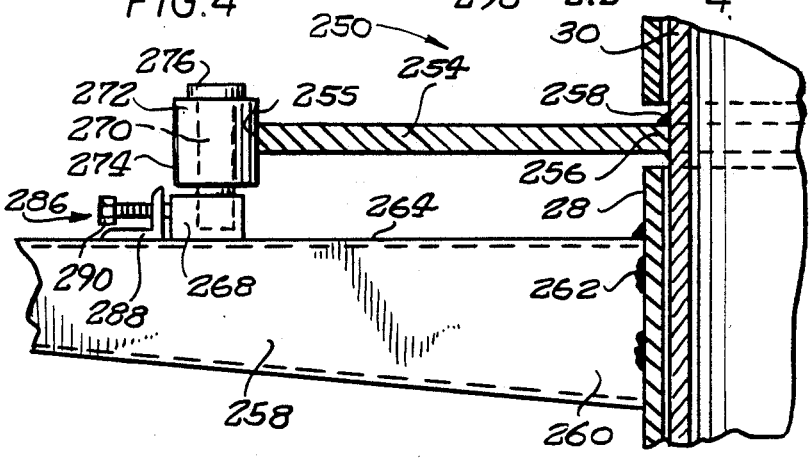
FIG. 4 is an enlarged fragmentary, view taken substantially along the line 4—4 of FIG. 3 and looking in the direction of the arrows.
Figure 5:
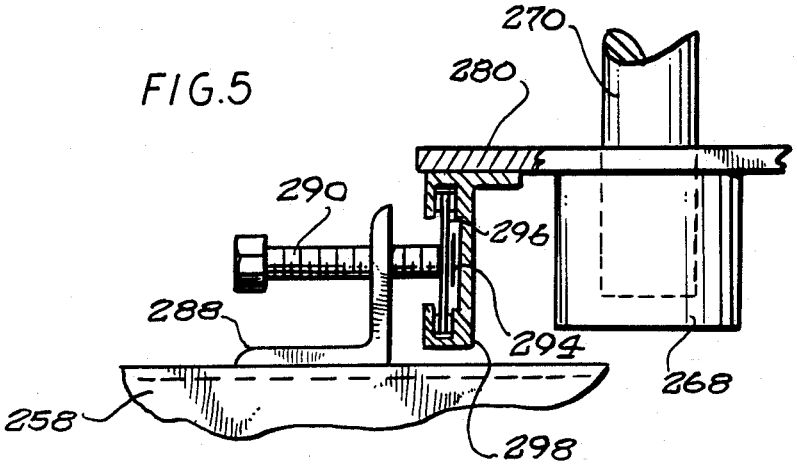
FIG. 5 is an enlarged fragmentary view of FIG. 4 shown partly in cross-section.

The upper rotational support 250 further includes three equally spaced arms 258, radially outwardly extending from the outer movable column 28. Arms 258 have radially inner ends 260 which are preferably welded at 262 to the outer movable column 28. As indicated in FIG. 4, the plurality of arms 258 extend beneath the guide plate 254. Attached to an upper surface 264 of arms 258 is a bearing block 268 for rotatably supporting a vertical shaft 270 extending upwardly away therefrom. A cylindrical roller 272, having an outer surface 274, is rotatably mounted on shaft 270. An enlarged head 276 of the shaft maintains the roller 272 captive thereon.

Figure 3:
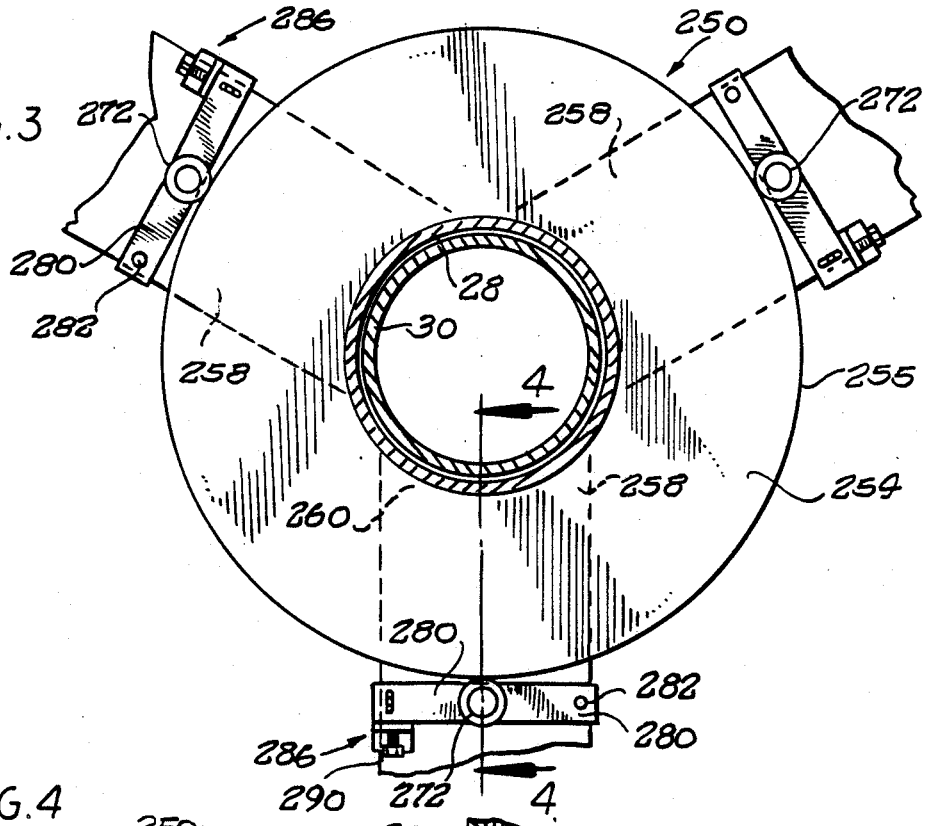
FIG. 3 is a partial plan view taken in cross-section substantially along the line 3—3 of FIG. 1 and looking in the direction of the arrows.

As indicated in FIG. 4, the outer surface 274 of roller 272 rides along the outer surface 255 of guide plate 254. Referring to FIG. 3, the guide rollers 272 located about the outer column 28, are spaced for engagement with the outer guide surface 255 of plate 254, and accordingly, are concentrically aligned with respect to the axis of rotation of the outer column. By maintaining an intimate engagement (i.e., eliminating spacing or gaps) between the guide rollers 272 and the outer surface 255 of guide plate 254, the guide rollers 272 eliminate any wobble of the outer column 28, even when bearing cantilever loads, as the column is rotated to carry turntable 33 to its various angular positions. Thus, there is provided a very large bearing device at the top of the rotatable column support 28 that can be adjusted by moving one or more of the rollers 272 radially until the upper portion of the column support is rotating about the desired vertical axis.

Turning again to FIGS. 3–5, the desired close spacing alignment of rollers 272 with guide surface 255 is preferably provided by mounting the guide rollers 272 at a point along a horizontally disposed mounting arm 280. Arm 280 is pivotally mounted at 282 to arm 258, so as to be pivotable in a generally horizontal plane. The bearing 268 supporting the guide rollers 272 may be mounted directly to arm 258, as described above, but preferably is mounted at a medial portion of arm 280, and travels along an arcuate path concentric with the pivotable mounting 282. Thus, by swinging arm 280 about its pivotable mounting 282, guide roller 272 can be moved back and forth, toward and away from the guide surface 255 of plate 254. To maintain arms 280, and hence the guide roller 272, in a desired fixed position, a screw adjustment generally indicated at 286 may be used The adjustment 286 preferably includes an L-shaped bracket 288 having a lower, generally horizontal leg secured to arm 258, and a generally vertical leg receiving a threaded fastener 290. The free end of the threaded fastener 290 is secured to the free end of arm 280, so as to be rigidly secured thereto against movement in generally radially directions, while being free to turn within the threaded bore in the vertical leg of bracket 288. If desired, a spring may be interposed between the vertical leg of bracket 288 and the end of arm 280, such that radially outward displacement reaction forces generated in the guide roller 272 are absorbed by the spring. However, it is generally preferred that a spring loading not be provided so as to closely control and essentially eliminate any wobble in the upper portion of outer column 28.

For example, a washer-like ring 294 may be located in the groove at the free end of threaded fastener 290, the ring having inner and outer diameters smaller and larger than the outer diameter of fastener 29. The washer 294 is installed within a slot 296 formed in the interior of a bracket 298 secured to arm 280. Thus, as threaded fastener 290 is turned in opposite directions of rotation, arm 280 and hence guide roller 272 mounted thereon, is moved toward and away from the guide surface 255 of plate 254. Other arrangements for providing a plurality of guide means in contact with the rotatable column to restrict inclination of the rotatable column away from a vertical axis of rotation will now become apparent in light of the above teachings, and such is considered to be within the scope of the present invention.

These features, as will be appreciated, are provided in a complete printing apparatus which mounts both pivoting printing units and rotating pallet-supporting arms in cantilever fashion from central column supports. This arrangement maintains support at the periphery of those components, further assuring the accuracy of alignment between the printing screen (secured to the pivoting print head) and the pallet, (secured to the rotating pallet support) which carries the workpiece.

While the invention has been described with reference to a preferred embodiment, it will be understood to those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In a mechanized screen printing apparatus, the combination comprising: frame means including a vertical stationary inner shaft having a vertical axis, an outer rotatable column rotatable about the inner shaft and encircling the same and having a vertical rotational axis, screen printing means for printing at each of a plurality of stations and including means on the rotatable column to be turned in a circular path from station to station for registration between successive screen printing operations, means for mounting said rotatable column for rotation about said vertical axis, comprising:

a collar centered on the column rotation axis and secured to said rotatable column at a lower end thereof with a bottom surface defining an upwardly-facing continuous groove centered on said rotational axis;

a base beneath the lower end of said rotatable column to give loadbearing support thereto, said base having an upper surface defining a downwardly-extending continuous groove centered on said column rotational axis;

means for mounting said base so that the groove thereof directly opposes the groove of said collar;

rolling bearing means between said collar and said base disposed in the grooves thereof so as to support said rotatable column for rotation about said vertical column rotational axis;

a circular surface secured to the inner shaft at a location above the collar and centered on the shaft's vertical axis, a plurality of rollers traveling with the rotatable column and engaging the circular surface, and means mounting said rollers for radial movement relative to one another and to the shaft's rotational axis to adjust the center of upper end of the column to rotate about the shaft's vertical axis.

2. The apparatus of claim 1 in which the stationary inner shaft supports a plurality of printing units, and a stationary mounting means on the stationary inner shaft supporting the printing units at fixed locations relative to the stationary inner shaft.

3. The apparatus of claim 1 further comprising stationary means at each printing station for supporting said work supports during a printing operation.

4. In a screen printing apparatus for multi-color printing on a workpiece, the combination comprising:

a plurality of screen printing means supported on and above the stationary frame for printing on work pieces at each of a plurality of printing stations located about a central vertical axis, a portion of the screen printing means being indexed to the respective printing stations, a stationary frame;

a rotatable indexer mounted for rotation in said frame and carrying a portion of the screen printing means into and through the plurality of printing stations, an index drive means for driving the indexer through predetermined increments of rotation, a locking means for locking the indexer at a registration position to register the portion of the screen printing means at the stations for another print in register with a previously applied print, including a plurality of stationary brake members on the stationary frame for engagement with the indexer at spaced circumferential locations about the vertical axis each associated with a respective printing station prior to the stopping of the indexer in its indexing movement, cam means on the indexer, and an alignment means on the stationary frame selectively positioned with respect to each printing station, said alignment means locking the indexer in preselected alignment with a printing station.

5. The screen printing apparatus of claim 4 in which the rotation portion of the screen printing means comprising a plurality of indexable work supports supported in a cantilever manner with a tendency to move downwardly when printing pressure is applied to the workpiece on the work support, said stationary brake members include a brake shoe member associated with each work support positioned at each printing station to engage a portion of the as the work support is moved toward the printing station and to hold the work support against downward movement when printing pressure is applied to the work support.

6. The screen printing apparatus of claim 4 wherein said cam engaging means comprises a fork-like member movable toward and away from the cam means, and linkage means connecting said fork to said index drive means to align said cam-engaging means with said cam means as said indexer is rotated.

7. The screen printing apparatus of claim 6 wherein said cam means comprises a roller means mounted on the indexer and protruding therebeyond so as to be receivable in a crotch of the fork.

8. In an automatic screen printing apparatus including a fixed central column having a vertical axis and supporting a plurality of printing units circumferentially spaced about said vertical axis so as to define a plurality of printing stations, and a rotatable coaxial column carrying a plurality of work supports each transporting a workpiece toward and away from a printing station, means for mounting said rotatable column for rotation about a vertical rotational axis, comprising:

a collar secured about said coaxial column at a lower end thereof with a bottom surface defining an upwardly-facing continuous circular groove having an axis aligned with the rotational axis of the column;

a base beneath the lower end of said coaxial column to give loadbearing support thereto, said base having an upper surface defining a downwardly-extending continuous circular groove having an axis aligned with the rotational axis of the column;

means for mounting said base so that the groove thereof directly opposes the groove of said collar;

ball bearings between said collar and said base disposed in the grooves thereof so as to support said coaxial column for rotation about said column rotational axis and to hold the column against radial displacement; and a plurality of guide means in contact with said coaxial column and above said collar to restrict inclination of said coaxial column away from said central column's vertical axis, said guide means comprising a circular plate centered about the central column's vertical axis and a plurality of circumferentially spaced rollers engageable with the circular plate and being individual movable relative to the plate in a radial direction to shift the rotational column's axis into alignment with the vertical axis of the fixed central column.

9. In a mechanized screen printing apparatus, the combination comprising: a stationary inner shaft having a vertical axis, an outer rotatable column rotatable about the inner shaft and encircling the same, work supports on the rotatable column to be turned in a circular path from station to station for registration between successive screen printing operations, means for mounting said rotatable column for rotation about its vertical rotational axis, comprising:

a collar secured about said rotatable column at a lower end thereof with a bottom surface defining an upwardly-facing continuous groove;

a base beneath the lower end of said rotatable column to give loadbearing support thereto, said base having an upper surface defining a downwardly-extending continuous groove;

means for mounting said base so that the groove thereof directly opposes the groove of said collar;

rolling bearing means between said collar and said base disposed in the grooves thereof so as to support said rotatable column for rotation about said vertical rotation axis;

a plurality of guide means in contact with said rotatable column from and above said collar to restrict inclination of said rotatable column away from said vertical rotational axis, said guide means comprising a circular surface secured to the inner shaft and plurality of rollers are mounted on the rotatable column and engage the circular surface to center the upper end of the column to rotate about the shaft's vertical axis, said stationary inner shaft supporting a plurality of printing units;

a guide plate outwardly extending from said central column and having the outer circular surface concentrically arranged with said shaft's vertical axis, a plurality of outwardly-extending arms mounted to said rotatable column for rotation therewith, and means for mounting said plurality of guide means to said plurality of arms, so as to position said guide means for contact with the outer edge of said guide plate.

10. The apparatus of claim 9 wherein said guide means comprises roller means adjustably mounted to said arms for movement toward and away from the outer surface of said guide plate, thereby providing an adjustment for bringing said rotatable column into alignment with said vertical axis.

11. In a mechanized screen printing apparatus, the combination comprising: a stationary inner shaft having a vertical axis, an outer rotatable column rotatable about the inner shaft and encircling the same, work supports on the rotatable column to be turned in a circular path from station to station for registration between successive screen printing operations, means for mounting said rotatable column for rotation about its vertical rotational axis, comprising:

a collar secured about said rotatable column at a lower end thereof with a bottom surface defining an upwardly-facing continuous groove;

a base beneath the lower end of said rotatable column to give loadbearing support thereto, said base having an upper surface defining a downwardly-extending continuous groove;

means for mounting said base so that the groove thereof directly opposes the groove of said collar;

rolling bearing means between said collar and said base disposed in the grooves thereof so as to support said rotatable column for rotation about its vertical rotational axis;

a plurality of guide means in contact with said rotatable column and above said collar to restrict inclination of said rotatable column away from said shaft's rotational axis, stationary means at each printing station for supporting said work supports during a printing operation, said rotation means comprising a pad having an upper surface positioned at said preselected vertical height and having an inclined leading edge for frictionally engaging said work supports to stop the rotation thereof, said inclined edge being blended into the upper surface of said pad so as to elevate said work support to said preselected vertical height as said work support engages said pad.

12. The apparatus of claim 11 further comprising locking and positioning means engageable with said work support to precisely position said work support at a preselected angular position along the rotatable path of said work support.

13. The apparatus of claim 12 wherein said locking and positioning means comprises a mounting means generally vertically movable toward and away from an overlying work support, and further comprising interengageable roller and fork means mounted on said work support and mounting means, said fork means including roller-engaging tapered walls defining a tapered recess for receiving said roller means so as to direct said roller means to a precise position with respect to said fork means.

14. The apparatus of claim 13 wherein said roller means is mounted on said work support and said fork means is mounted on said mounting means, said fork means vertically movable toward and away from said roller means when a work support mounting said roller means is closed above said vertically movable mounting means.

* * * * *